US009133766B2

(12) United States Patent
Strusch et al.

(10) Patent No.: US 9,133,766 B2
(45) Date of Patent: Sep. 15, 2015

(54) INTERNAL COMBUSTION ENGINE

(75) Inventors: Wolfgang Strusch, Cologne (DE); Heinz Wieland, Bergisch-Gladbach (DE); Martin Schneider, Windeck (DE); Ralph Oberzier, Cologne (DE)

(73) Assignee: Deutz Aktiengesellschaft, Cologne (DE)

( * ) Notice: Subject to any disclaimer, the term of this patent is extended or adjusted under 35 U.S.C. 154(b) by 40 days.

(21) Appl. No.: 13/877,557

(22) PCT Filed: Sep. 29, 2011

(86) PCT No.: PCT/EP2011/004852

§ 371 (c)(1),
(2), (4) Date: Apr. 3, 2013

(87) PCT Pub. No.: WO2012/045407

PCT Pub. Date: Apr. 12, 2012

(65) Prior Publication Data

US 2013/0239916 A1 Sep. 19, 2013

(30) Foreign Application Priority Data

Oct. 6, 2010 (DE) ..... 10 2010 047 700

(51) Int. Cl.

| | |
|---|---|
| ***F01L 1/18*** | (2006.01) |
| ***F02B 77/00*** | (2006.01) |
| ***F01L 1/26*** | (2006.01) |
| ***F01M 9/10*** | (2006.01) |

(52) U.S. Cl.

CPC ..... *F02B 77/00* (2013.01); *F01L 1/181* (2013.01); *F01L 1/26* (2013.01); *F01M 9/10* (2013.01); *F01M 9/105* (2013.01); *F01M 9/107* (2013.01)

(58) Field of Classification Search

CPC ..... F01L 1/181; F01L 1/26; F01M 9/107
USPC ..... 123/90.39, 90.22, 90.23, 90.4, 90.44
See application file for complete search history.

(56) References Cited

U.S. PATENT DOCUMENTS

| | | | | |
|---|---|---|---|---|
| 1,855,166 A | | 4/1932 | Crawford | |
| 2,025,836 A | | 12/1935 | Treiber | |
| 2,641,235 A | * | 6/1953 | Slonneger | 123/90.39 |
| 2,769,434 A | | 11/1956 | Witzky | |
| 2,908,262 A | | 10/1959 | Gropp | |

(Continued)

FOREIGN PATENT DOCUMENTS

| | | |
|---|---|---|
| DE | 1799511 | 11/1959 |
| DE | 11 79 764 | 10/1964 |

(Continued)

OTHER PUBLICATIONS

Plate 33, PA 52, in "Power Unit service Parts List 998,cc, 1098 cc and 1275cc 4-cylinder petrol transverse AKD5103", Jan. 1, 1969, british Leyland motor corporation limited, oxford, vol. akd 5103: 6pgs.

*Primary Examiner* — Ching Chang
(74) *Attorney, Agent, or Firm* — Davidson, Davidson & Kappel, LLC

(57) ABSTRACT

An internal combustion engine including at least one cylinder, at least one in-block camshaft, at least one overhead intake valve and at least one overhead exhaust valve, as well as at least one rocker arm bracket per cylinder, the rocker arm bracket having an in particular tubular shaft on which are mounted at least one exhaust rocker arm and at least one intake rocker arm.

14 Claims, 12 Drawing Sheets

(56) References Cited

U.S. PATENT DOCUMENTS

| | | | | | |
|---|---|---|---|---|---|
| 3,008,544 | A | | 11/1960 | Krizman | |
| 3,138,146 | A | | 6/1964 | Hutchison | |
| 4,365,595 | A | * | 12/1982 | Piatti | 123/90.53 |
| 4,655,177 | A | | 4/1987 | Wells et al. | |
| 4,922,867 | A | | 5/1990 | Mathews | |
| 5,005,544 | A | | 4/1991 | Spangler | |
| 5,264,315 | A | | 11/1993 | Tan et al. | |
| 5,553,583 | A | | 9/1996 | Jones | |
| 5,586,533 | A | * | 12/1996 | Feucht | 123/321 |
| 5,954,018 | A | * | 9/1999 | Joshi | 123/90.16 |
| 6,250,269 | B1 | * | 6/2001 | Kawasaki | 123/90.39 |
| 7,424,876 | B2 | * | 9/2008 | Diggs | 123/90.41 |

FOREIGN PATENT DOCUMENTS

| | | |
|---|---|---|
| DE | 3637199 | 5/1988 |
| GB | 873 652 | 7/1961 |
| GB | 953022 | 3/1964 |
| JP | H0627717 | 2/1994 |

* cited by examiner

INTERNAL COMBUSTION ENGINE

The present invention relates to an internal combustion engine.

BACKGROUND

When using four-valve cylinder heads having two intake valves and two exhaust valves per cylinder, the timing is more complicated than in the case of two-valve cylinder heads. In the latter, the injector is at an angle to the cylinder axis, and the two valves can be disposed at the center of the cylinder head. In contrast, in the case of four-valve cylinder heads, the aim is to mount the injector vertically, and to distribute the four gas-exchange valves around the injector two parallel to each other. In the four-valve cylinder head, the valve seats need to be optimized in terms of position and size, and the rocker arm pushrods are disposed on the "cold" intake side of the cylinder head. As a result, the installation of the rocker arm bearing becomes much more difficult because the valve spring clearances reduce the size of the rocker arm seating.

German Patent Publication DE-AS 11 79 764 describes a valve control system for an internal combustion engine having two intake valves and two outlet valves per cylinder, where the equidirectionally acting arms of the two rocker arms have different lengths, and the arms of each rocker arm lie in a plane perpendicular to its pivot axis, which is disposed at an angle to the longitudinal central plane of the internal combustion engine. Given a suitable arrangement of the control shaft and of the intake and exhaust pipes relative to each other, the above-described measures make it possible to obtain a wear-resistant valve control system with a minimum of effort. While this rocker arm design eliminates the wear-promoting transverse forces, this manner of mounting markedly increases the ratio between the lift of the valve and the lift of the lifter, which corresponds to an increase in forces and in the Hertzian stress between the cam and the lifter, whose magnitude is one of the determinants of the durability of the components concerned. Since the contours of the rocker shaft, and consequently also that of the bearing bolt, extend beyond the cylinder head, vibration-free mounting of the pedestal on or to the cylinder head is very complex and requires additional reinforcement of the cylinder head at the mounting points, especially at the point near the exhaust port and at the point near the intake port.

German Patent Publication DE 3637199 discloses a rocker arm bracket which is composed of at least three different separate parts.

SUMMARY OF THE INVENTION

This has the disadvantage, inter alia, of high manufacturing cost, which is due to the the numerous different separate parts.

It is an object of the present invention to overcome the above-mentioned drawbacks, and to provide a rocker arm bracket which is compact and rigid in construction and capable of being mounted on the cylinder head in such a way that force flows directly to its mounting bolts and which, if several cylinders are provided, is multiply mounted on the internal combustion engine as an identical separate part, depending on the number of cylinders.

The present invention provides an internal combustion engine comprising at least one cylinder, at least one in-block camshaft, at least one overhead intake valve and at least one overhead exhaust valve, as well as at least one rocker arm bracket per cylinder, the rocker arm bracket having an in particular tubular shaft on which are mounted at least one exhaust rocker arm and at least one intake rocker arm.

In an advantageous embodiment of the present invention, at least two overhead intake valves and at least two overhead exhaust valves are provided per cylinder, which results in a cost-effective, rugged and high-output internal combustion engine.

Advantageous refinements of the invention are specified in the dependent

BRIEF DESCRIPTION OF THE DRAWINGS

Further features of the invention will become apparent from the following description and the drawings, which illustrate an exemplary embodiment and in which.

DETAILED DESCRIPTION

Figure 1:
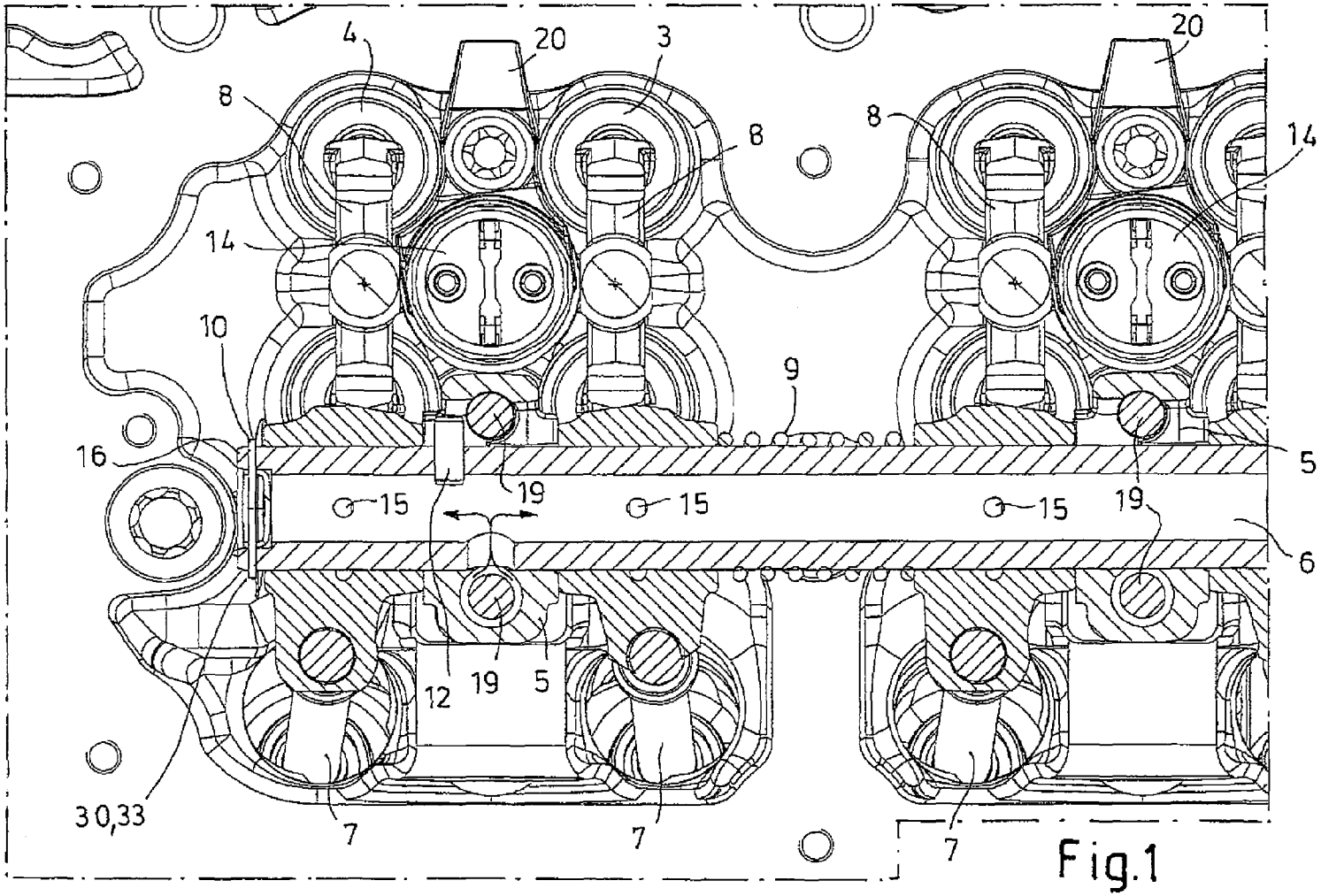
FIG. 1 shows a cross-sectional view through the cylinder head of the internal combustion engine.

The invention disclosed in the drawings relates to an internal combustion engine having at least one cylinder, an in-block camshaft, as well as two overhead intake valves and two overhead exhaust valves per cylinder.

Camshaft 2 has, for each cylinder, one cam 26 for actuating intake valves 3 and one cam 27 for actuating exhaust valves 4. The lift of the cam 26, 27 is transmitted to the two valves by a lifter 28 (either a flat lifter or a roller lifter), a pushrod 7, a rocker arm 8, and a valve bridge 23. Rocker arms 8 are all mounted on a continuous rocker shaft 6. Pushrods 7 are inclined such that they point toward the center of the cylinder at the top. This makes it possible to mount rocker arm bracket 5 at the center of the cylinder. The axial force component of pushrods 7 presses rocker arms 8 correspondingly against rocker arm bracket 5. An advantage in this connection is that rocker arm brackets 5 which are all identical in construction and shape can be used for all cylinders.

Figure 2:
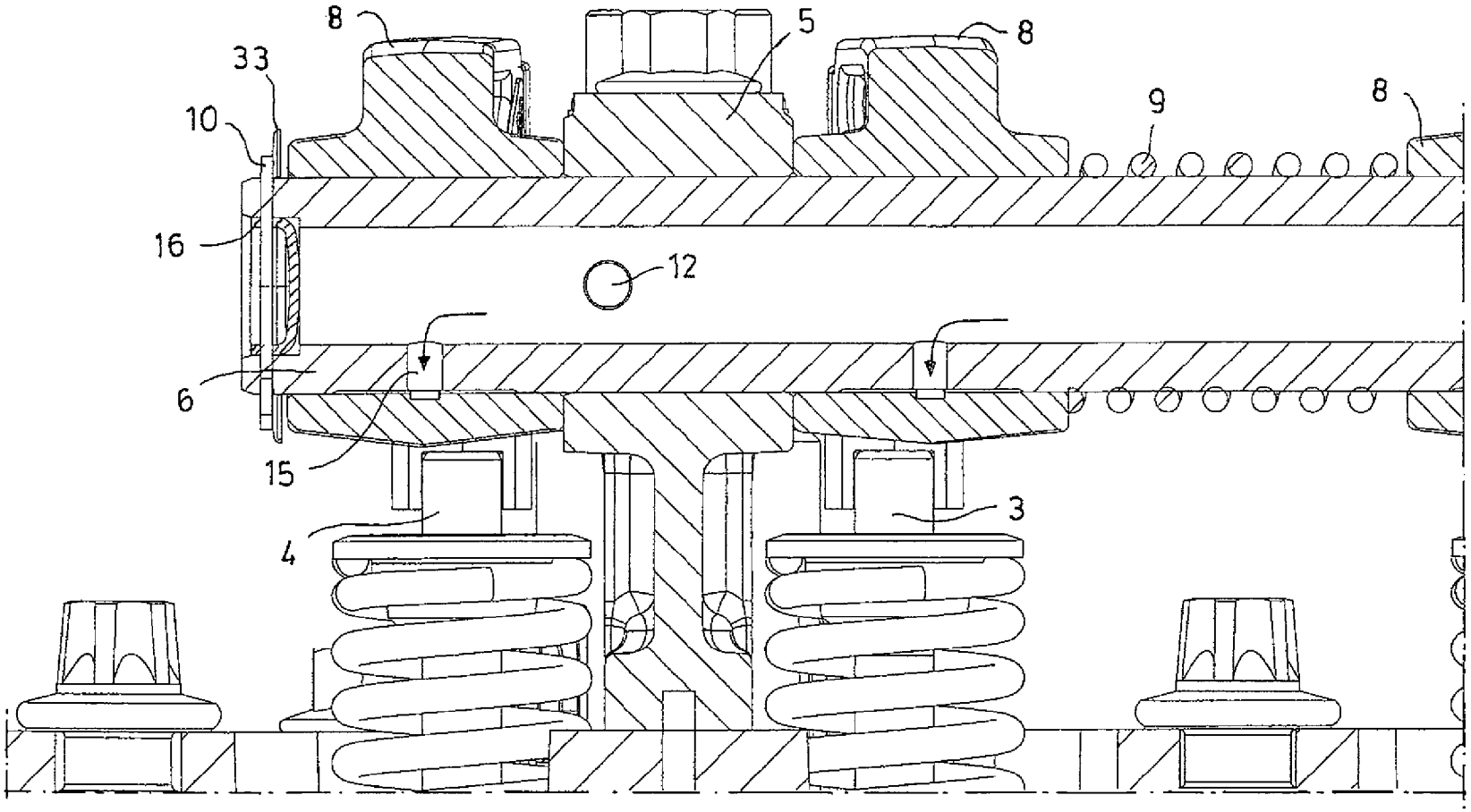
FIG. 2 shows a cross-sectional view through the cylinder head of the internal combustion engine.
Figure 3:
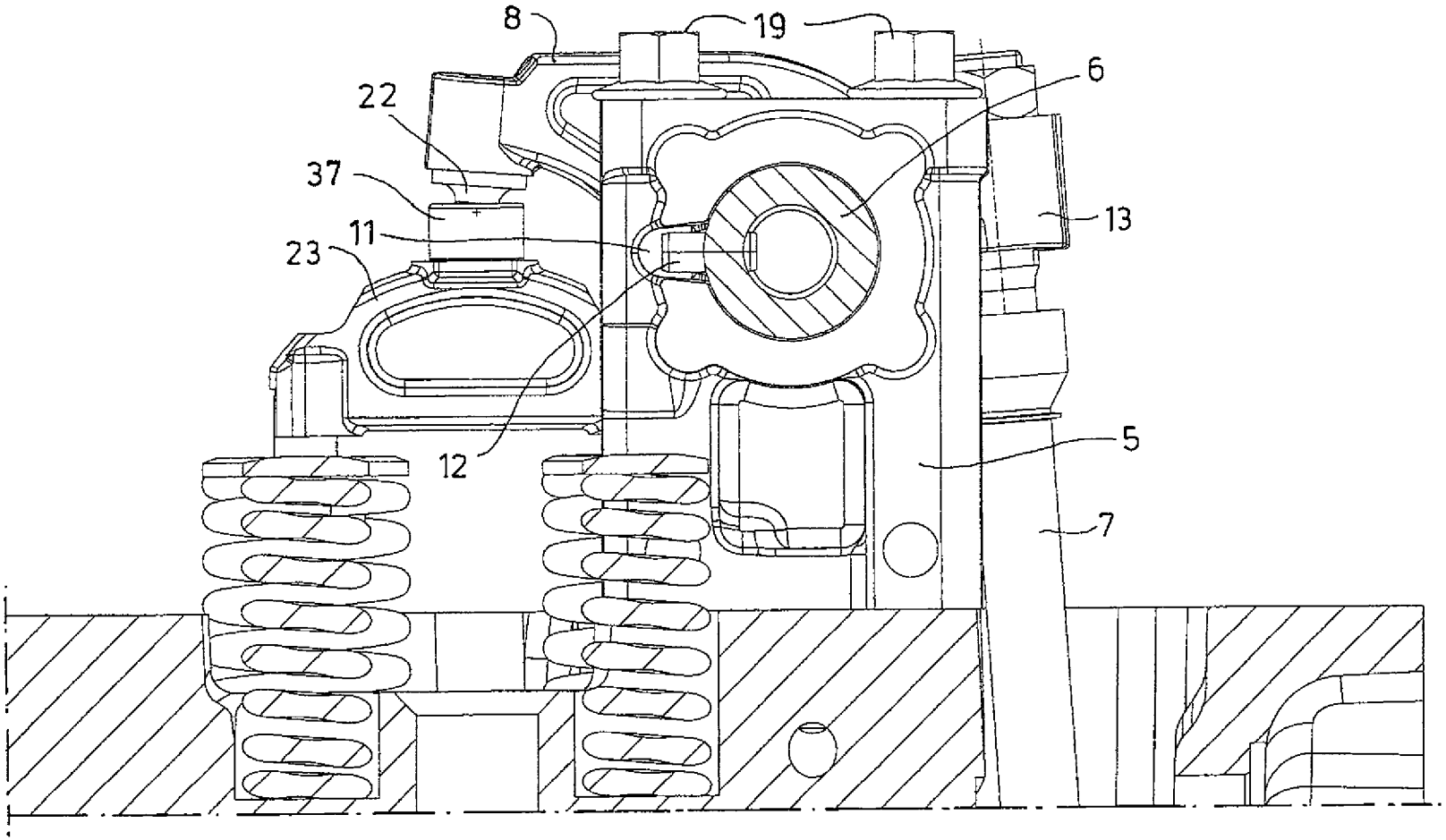
FIG. 3 shows a side view of the cylinder head.
Figure 5:
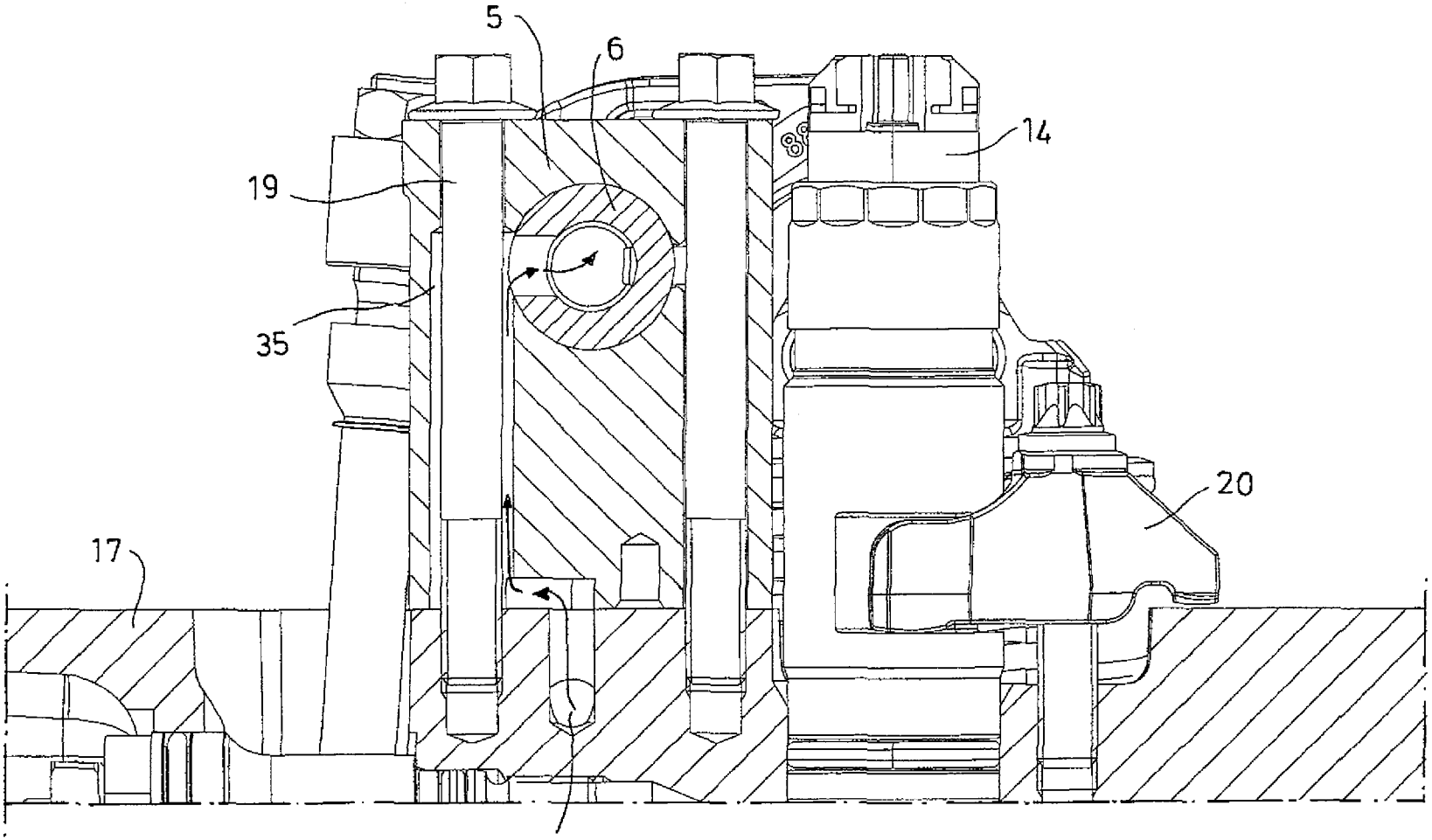
FIG. 5 shows a cross-sectional view through the cylinder head of the internal combustion engine.
Figure 6:
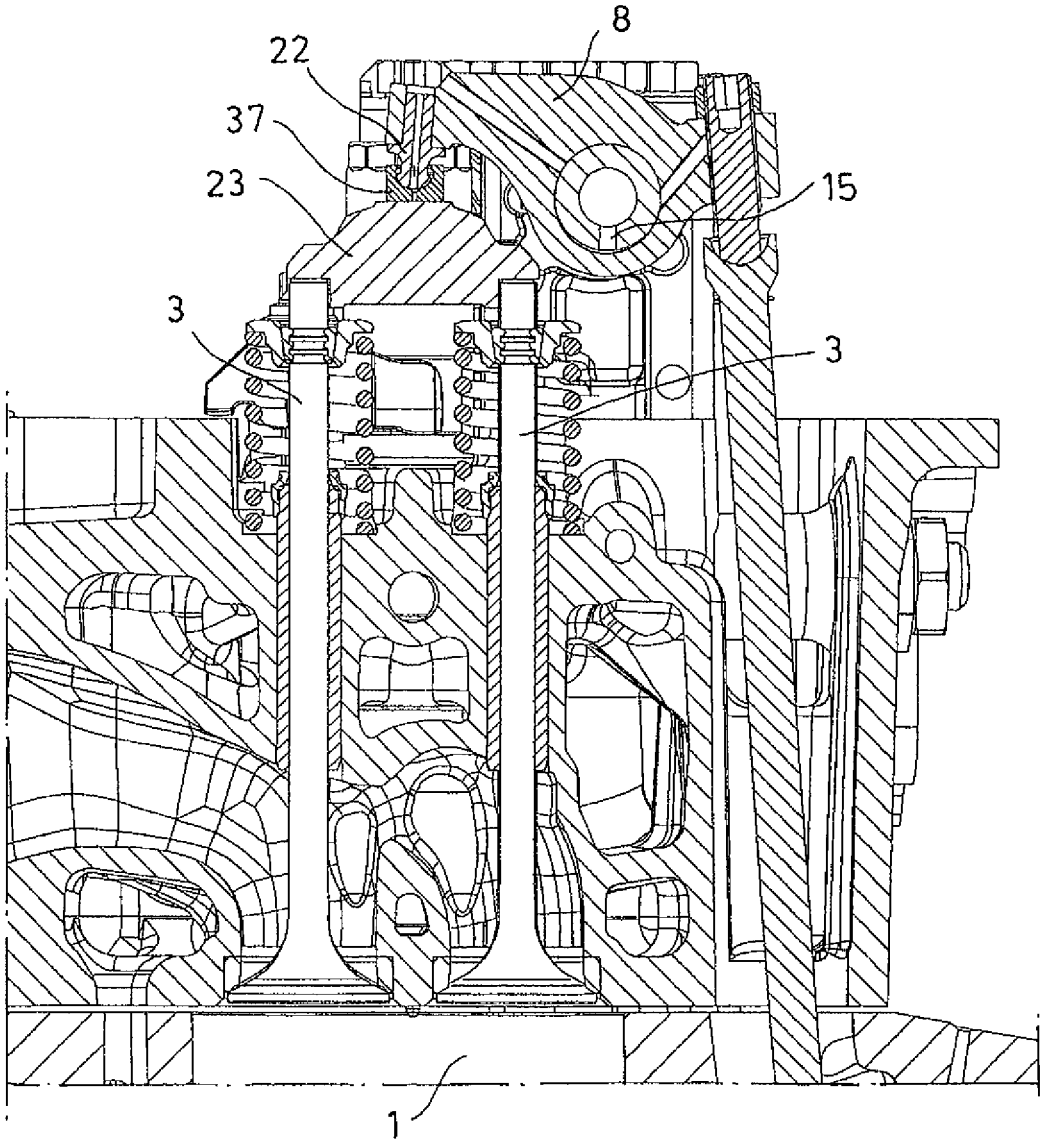
FIG. 6 shows a cross-sectional view through the cylinder head of the internal combustion engine.
Figure 7:
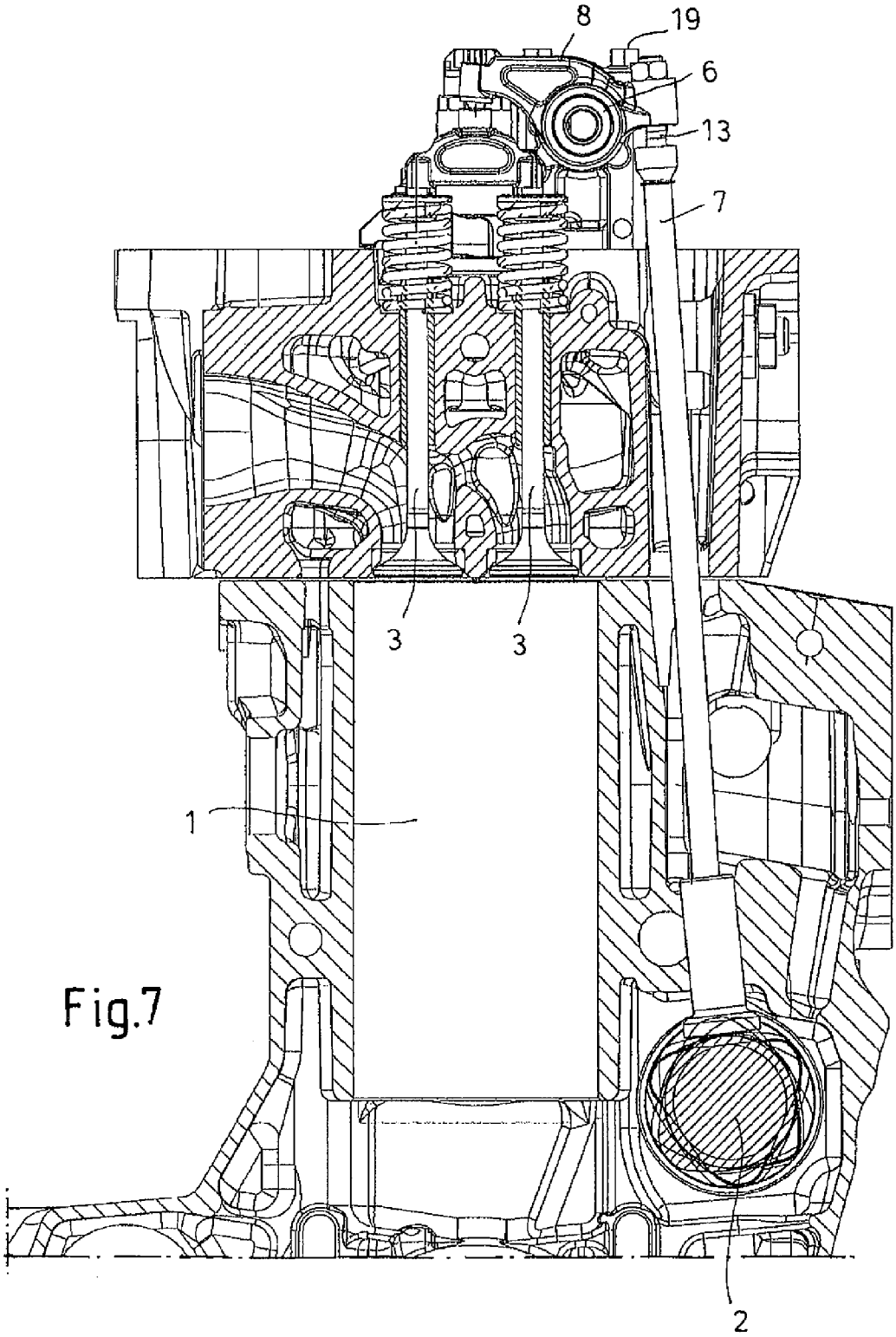
FIG. 7 shows a cross-sectional view through the cylinder head of the internal combustion engine.
Figure 8:
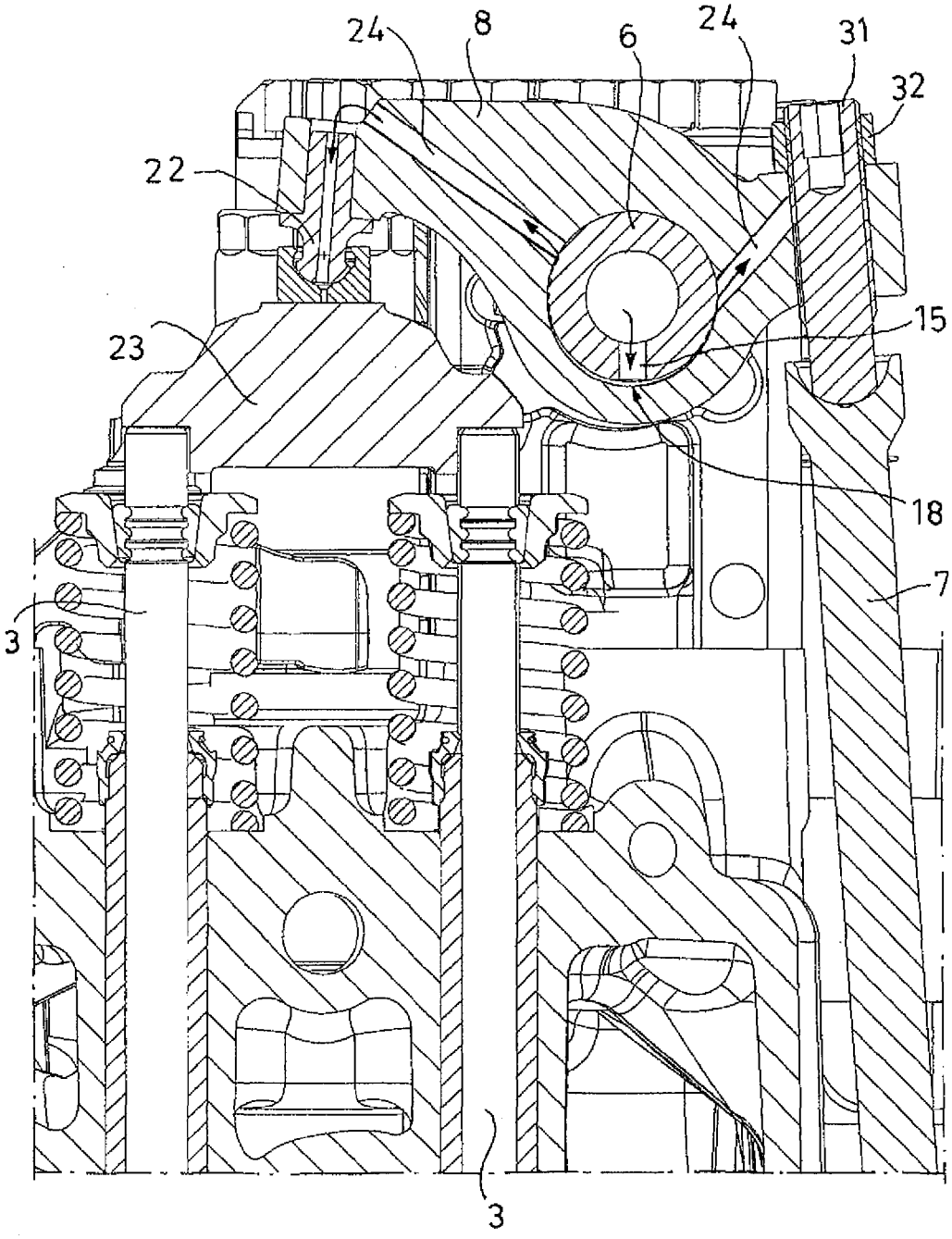
FIG. 8 shows a cross-sectional view through the cylinder head of the internal combustion engine.
Figure 9:
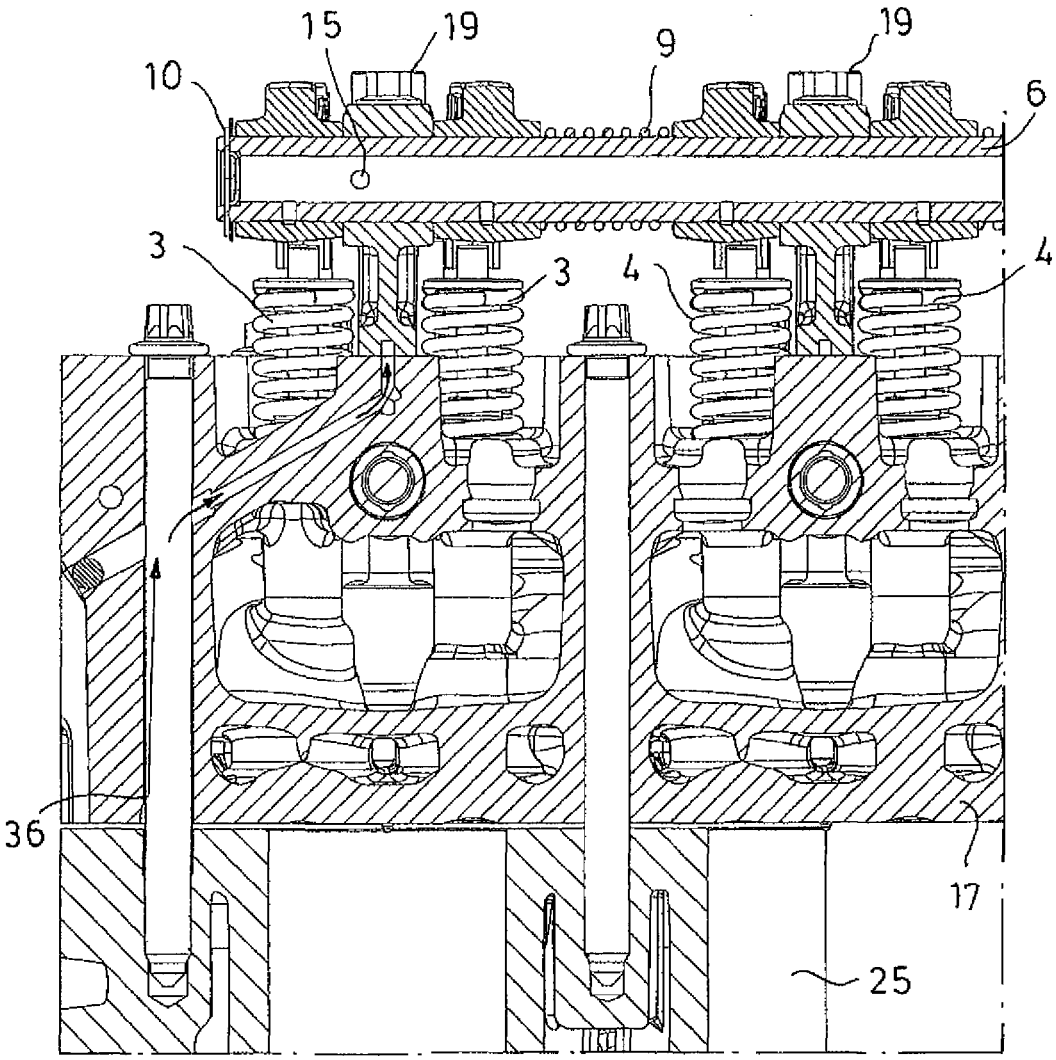
FIG. 9 shows a cross-sectional view through the cylinder head of the internal combustion engine.

A spring 9 is mounted on shaft 6 between the cylinders and acts to press rocker arms 8 against pedestals 8 so as to prevent dynamic axial displacement of rocker arms 8. At the two ends of rocker shaft 6, this pressing function is performed by a resilient corrugated washer 33. The rocker shaft is axially secured by retaining rings (circlips) 10 which are fitted onto rocker shaft 6. Rocker arm brackets 5 are mounted on the cylinder head by two bolts 19 each, said bolts being located to the right and left of shaft 6. Rocker arm bracket 5 is configured to have a groove on at least one side thereof, the groove weakening the pedestal in a controlled manner, allowing it to deform such that shaft 6 is clamped under the force of bolts 19. Another task of this groove is to receive a pin 12 fitted into and projecting from the shaft, said pin fixing shaft 6 against rotation. Installation in a predetermined positional orientation is necessary because of the lubrication holes 15, as is illustrated in FIGS. 1, 2, 6, 8 and 9. Lubrication oil flow 36 is supplied through a bore in cylinder head 17 and a centering groove 11 formed in rocker arm bracket 5, said centering groove being in communication with an enlarged bolt hole 35 in rocker arm bracket 5 and being in communication with the hollow shaft 6 via a hole in shaft 6, as is illustrated in FIGS. 3, 5 and 9. The shaft is hollow, allowing passage of the oil. At each of the rocker arms, the oil passes through a hole in the shaft into the bearing of the rocker arm. Shaft 6 has a shallow groove formed therein at each of rocker arms 8, said groove extending alongside shaft 6 and being a little shorter than the hub of the rocker arm. The bearing bore of rocker arm 8 has a crescent-shaped groove 18 therein which conducts the oil also to the oil passages 24 for lubricating the adjusting screw on the pushrod side and the thrust member on the valve side, as is illustrated by way of example in FIGS. 1, 2, 5, 8 and 9.

The thrust member acting on valve bridge 23 takes the form of a spherical foot (elephant foot or ball pin 22 with foot), but may also be a simple thrust member having a roll-off radius. The adjustment of the valve clearance is accomplished using the adjusting screw 31 on the pushrod side. In a variant, a hydraulic compensation element 13 is used which is integrated in rocker arm 8 on the pushrod side. Oil is supplied through the hole to the rocker arm bearing. Axial retainment and resilient support of the two rocker arms at the ends of the shaft may also be accomplished by a special clip which combines the two functions in one device. In FIG. 1, the cylinder head located on the cylinder (not shown) is shown from above. Intake valves 3 and exhaust valves 4 are actuated by an in-block camshaft via the rocker shaft 6 mounted in rocker arm bracket 5, and the rocker arms 8 supported by the rocker shaft, as well as pushrods 7. Rocker arms 8 are pressed against rocker arm brackets 5 by springs 9. Axial retainment of rocker shaft 6 is accomplished by a circlip or retaining ring 10.

Figure 4:
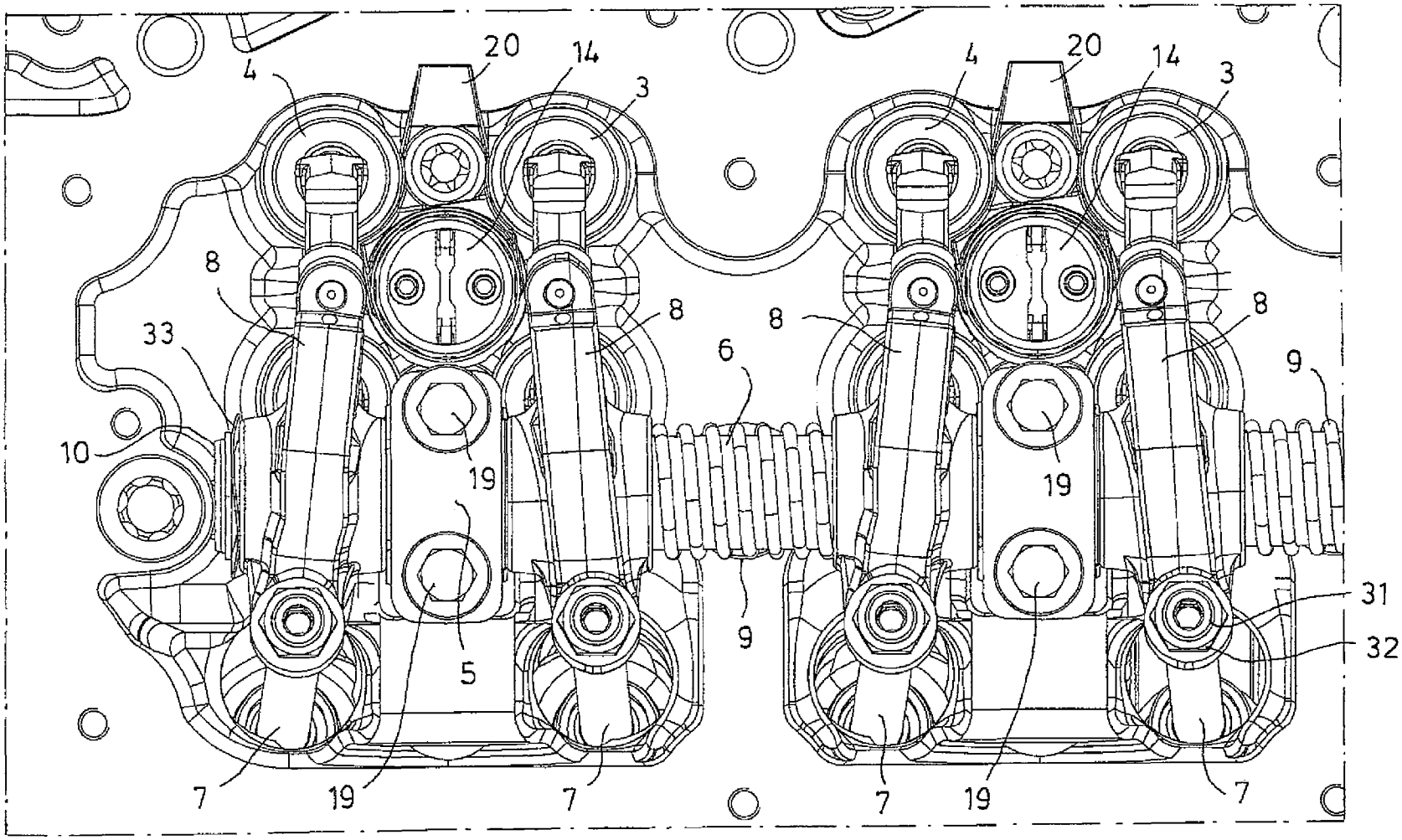
FIG. 4 shows a top view of a portion of the internal combustion engine.
Figure 10:
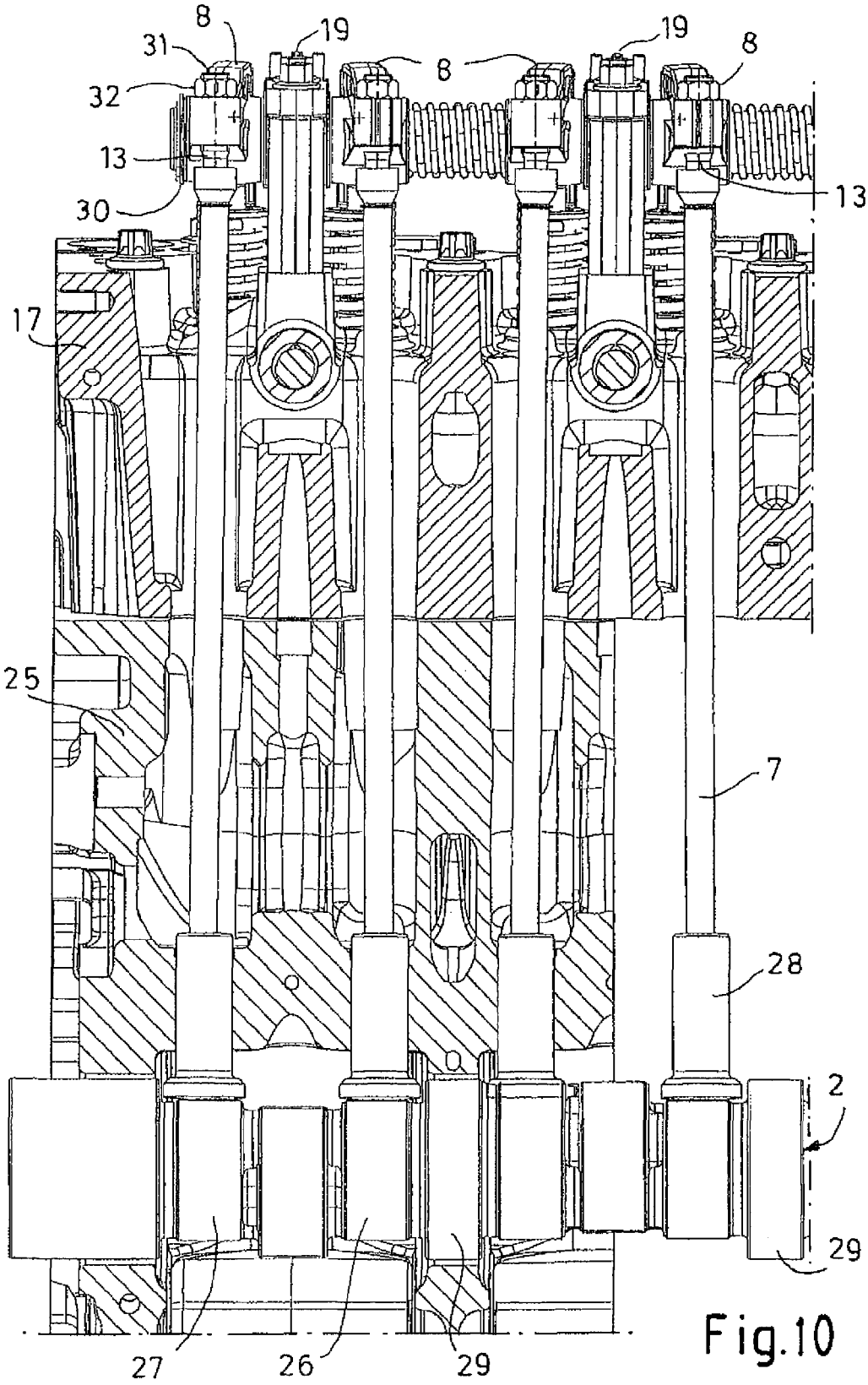
FIG. 10 shows a cross-sectional view through the cylinder head of the internal combustion engine.
Figure 11:
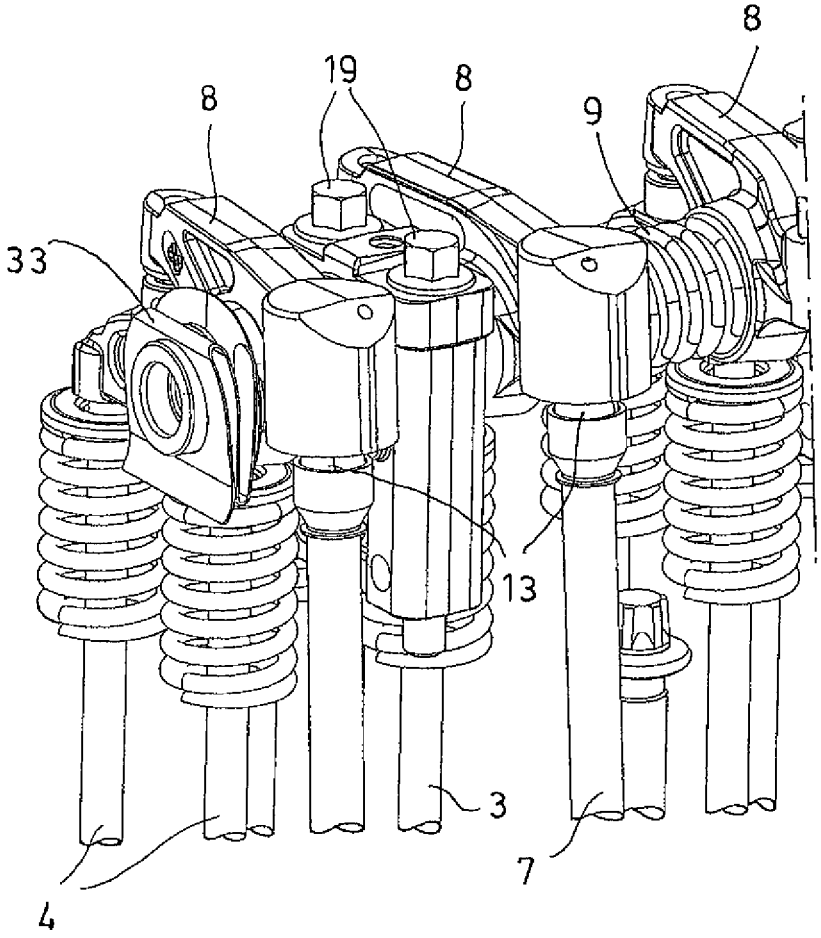
FIG. 11 shows a schematic view of the cylinder head of the internal combustion engine.
Figure 12:
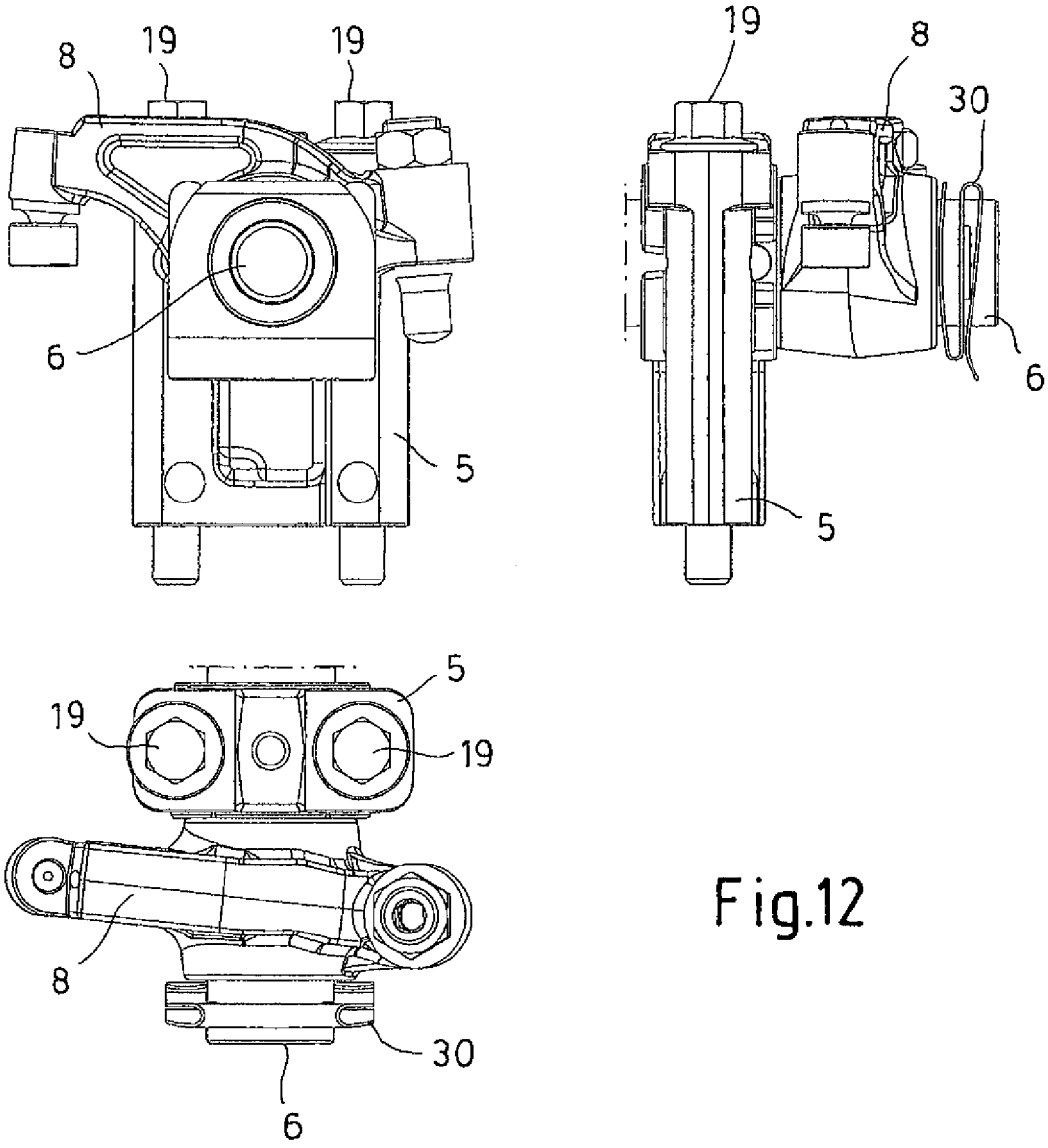
FIG. 12 shows different views of the rocker arm bracket of the internal combustion engine.

A hydraulic compensation element 13 is disposed between rocker arm 8 and pushrod 7 for play-free valve operation, as is illustrated in FIGS. 10 and 11. Injectors 14 are disposed between clamping claw 20, intake valves 3, exhaust valves 4, and rocker arm bracket 5, as is shown in FIGS. 1 and 4. In order to prevent escape of lubricating oil from rocker shaft 6, the rocker shaft is provided at each end with a sealing cover 16, as is illustrated in FIGS. 1 and 2. FIG. 10 schematically illustrates how the valves are actuated by camshaft 2, which is supported in crankcase 25 and provided with intake cams 26 and exhaust cams 27, and which actuates pushrods 7 via lifters 28. Camshaft 2 is supported by camshaft bearings 29. The rocker arms located at the ends are secured axially against rocker arm brackets 5 by special resilient clips 30, as is illustrated in FIGS. 1, 2, 4, 10 and 11.

A substantially play-free valve operation is achieved by means of adjusting screws 31 and lock nuts 32.

LIST OF REFERENCE NUMERALS

1 cylinder
2 camshaft
3 intake valve
4 exhaust valve
5 rocker arm bracket
6 rocker shaft
7 pushrod
8 rocker arm
9 spring
10 retaining ring
11 groove
12 centering pin
13 hydraulic compensation element
14 injector
15 lubrication hole
16 cover
17 cylinder head
18 rocker arm groove
19 rocker arm bracket mounting bolt
20 clamping claw
21 valve bridge
22 ball pin
23 valve bridge foot for receiving the ball pin
24 oil passage
25 crankcase
26 intake cam
27 exhaust cam
28 lifter
29 camshaft bearing
30 special resilient clip
31 adjusting screw
32 lock nut
33 resilient corrugated washer
34 sealing cover
35 enlarged bolt hole
36 oil flow
37 spherical foot

What is claimed is:

1. An internal combustion engine comprising:
at least one cylinder;
at least one in-block camshaft;
at least one overhead intake valve, at least one overhead exhaust valve, and at least one rocker arm bracket per cylinder;
the rocker arm bracket having a shaft, at least one exhaust rocker arm and at least one intake rocker arm being mounted on the shaft; and
at least one spring on an outer circumference of the shaft, the exhaust and intake rocker arms movably mounted on the shaft being pressed axially against the rocker arm bracket by the at least one spring,
wherein at least one of the exhaust and intake rocker arms includes a bearing bore for the shaft, the bearing bore having a crescent-shaped groove therein which conducts oil to oil passages for lubricating both an adjusting screw on a pushrod side of the at least one of the exhaust and intake rocker arms and a thrust member on a valve side of the at least one of the exhaust and intake rocker arms.

2. The internal combustion engine as recited in claim 1 wherein there are at least two of the overhead intake valves and at least two of the overhead exhaust valves per cylinder.

3. The internal combustion engine as recited in claim 1 further comprising at least two pushrods per cylinder, the pushrods being inclined in a direction toward the center of the cylinder.

4. The internal combustion engine as recited in claim 1 wherein at least one retaining ring or circlip is provided on the shaft.

5. The internal combustion engine as recited in claim 1 wherein the rocker arm bracket is mounted on the cylinder head by at least two bolts.

6. The internal combustion engine as recited in claim 1 wherein the rocker arm bracket has at least one groove.

7. The internal combustion engine as recited in claim 1 wherein the shaft has at least one centering pin, the centering pin resting in a groove of the rocker arm bracket.

8. The internal combustion engine as recited in claim 1 wherein the shaft and the exhaust and intake rocker arms have communicating grooves, the groove of the shaft communicating with the interior of the shaft via a hole.

9. The internal combustion engine as recited in claim 1 wherein the rocker arm bracket is made of light metal.

10. The internal combustion engine as recited in claim 1 wherein the shaft is tubular.

11. An internal combustion engine comprising:

at least one cylinder;

at least one in-block camshaft;

at least one overhead intake valve, at least one overhead exhaust valve, and at least one rocker arm bracket per cylinder;

the rocker arm bracket having a shaft, at least one exhaust rocker arm and at least one intake rocker arm being mounted on the shaft, the rocker arm bracket having at least one groove, the shaft including at least one centering pin projecting from an outer surface of the shaft, the centering pin resting in a groove of the rocker arm bracket.

12. The internal combustion engine as recited in claim 11 further comprising at least one spring, the exhaust and intake rocker arms movably mounted on the shaft being pressed against the rocker arm bracket by the at least one spring.

13. The internal combustion engine as recited in claim 12 wherein the spring is in the form of a coil spring.

14. The internal combustion engine as recited in claim 12 wherein the spring is in the form of a disk or diaphragm spring.

* * * * *